US006214179B1

(12) United States Patent
Cartner

(10) Patent No.: US 6,214,179 B1
(45) Date of Patent: Apr. 10, 2001

(54) ELECTROWINNING CELL

(75) Inventor: William Norman Cartner, Randburg (ZA)

(73) Assignee: Kemix (Proprietary) Limited, Midrand (ZA)

( * ) Notice: Subject to any disclaimer, the term of this patent is extended or adjusted under 35 U.S.C. 154(b) by 0 days.

(21) Appl. No.: 09/220,773

(22) Filed: Dec. 28, 1998

(30) Foreign Application Priority Data

Dec. 28, 1997 (ZA) ..... 97/10722

(51) Int. Cl.[7] ..... C25D 17/00; C25B 15/00; C25B 9/00; C25B 11/00

(52) U.S. Cl. ..... 204/212; 204/227; 204/237; 204/272; 204/273; 204/275; 204/284

(58) Field of Search ..... 205/565, 571, 205/560; 204/212, 242, 237, 222, 275, 227, 272, 273

(56) References Cited

U.S. PATENT DOCUMENTS 3,477,926 * 11/1969 Snow et al. ..... 205/571 X
3,560,366 * 2/1971 Fisher ..... 204/212
3,806,434 * 4/1974 Goold et al. ..... 204/212 X
3,985,634 * 10/1976 Larson et al. ..... 204/212
4,028,199 * 6/1977 Holland ..... 205/560 X
5,324,396 * 6/1994 Ferron et al. ..... 205/571 X
5,902,465 * 5/1999 Pang ..... 204/212
6,017,428 * 1/2000 Hill ..... 204/242

* cited by examiner

*Primary Examiner*—Donald R. Valentine
(74) *Attorney, Agent, or Firm*—Young & Thompson

(57) ABSTRACT

This invention relates to a method of electrowinning metal from an eluate containing the metal in solution and includes the steps of feeding the eluate into a closed tank which includes a suitably electrified anode and cathode, electrolytically depositing metal from the eluate onto the cathode and at least periodically causing the deposited metal to be dislodged from the cathode for removal from the tank. Preferably the metal is dislodged from the cathode by movement of the cathode in the eluate in the tank. The invention further extends to an electrowinning cell for carrying out the method of the invention with the anode being in the form of a metal cylinder in which the cathode is rotatably located.

9 Claims, 2 Drawing Sheets

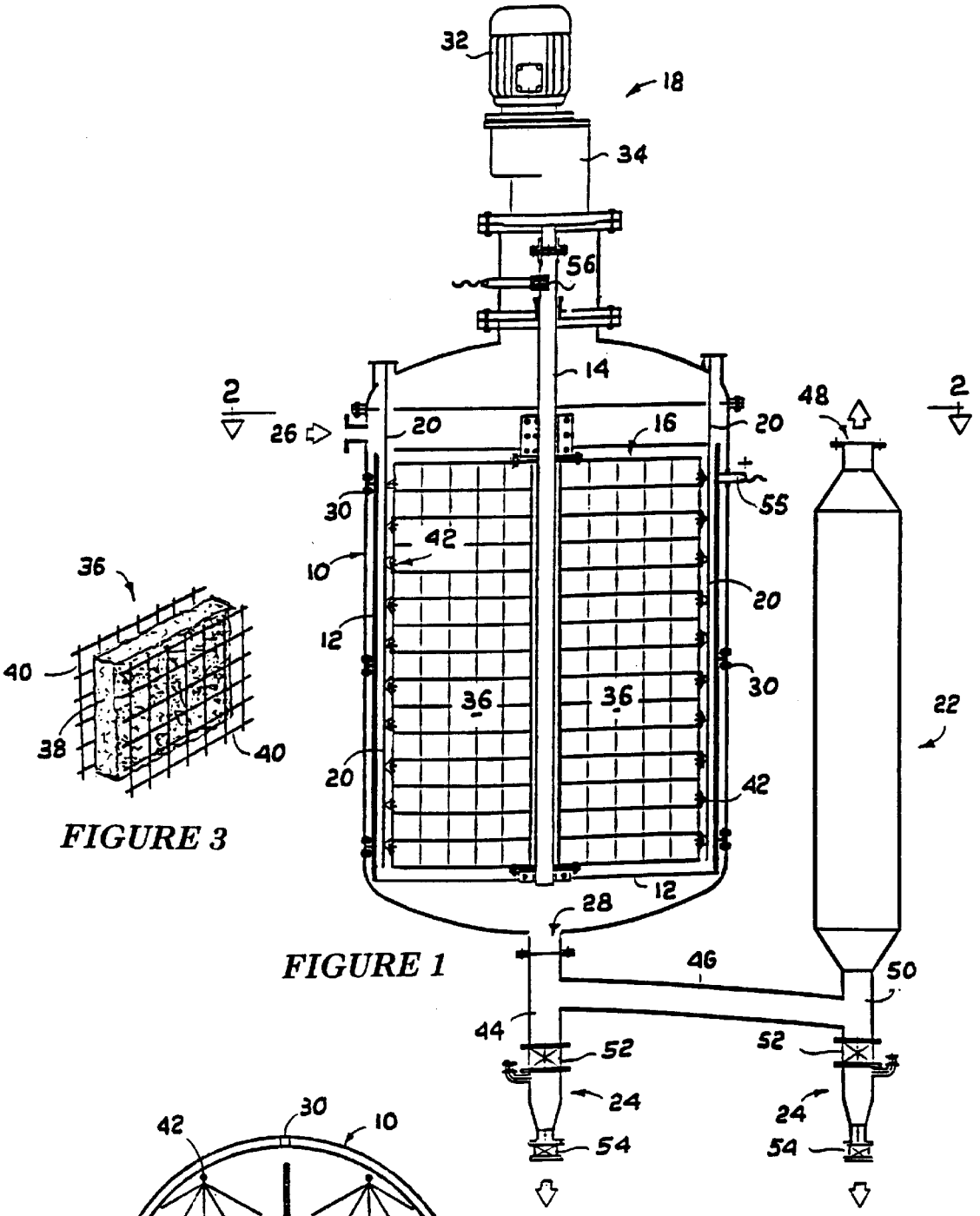
FIGURE 1
FIGURE 3
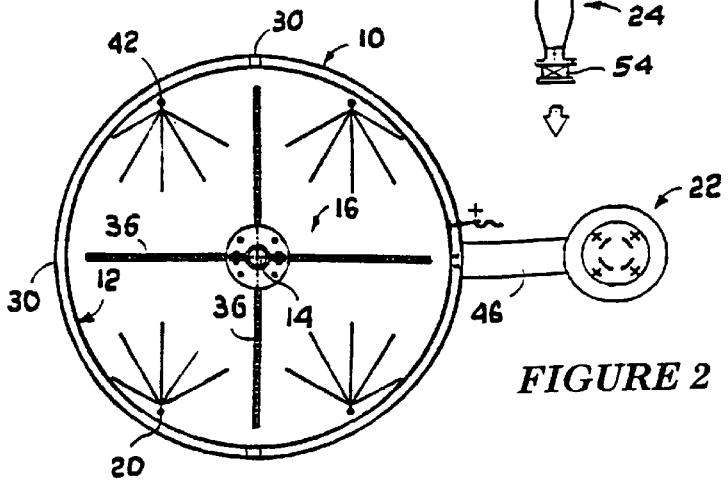
FIGURE 2

ELECTROWINNING CELL

FIELD OF THE INVENTION

This invention relates to a method of electrowinning metals such as gold, silver and the like from a metal-rich electrolyte and to an electrowinning cell for use in carrying out the method.

BACKGROUND TO THE INVENTION

Electrowinning cells for the recovery of gold are well known and consist fundamentally of a tank in which a static sandwich arrangement of alternate electrically connected anode and cathode assemblies are located in a flow path between the electrolyte inlet to the tank and an outlet weir from the tank.

In use, in one form of electrowinning, a gold rich eluate is fed into the tank through its inlet to pass between the electrified anodes and cathodes in the tank and from the tank through its outlet. In doing so a gold rich sludge is electrolytically built up on the low adhesion material of the cathodes and in time gravity separates from the cathodes to settle in a sump or gold trap in the base of the tank from where it is periodically removed.

The cathodes in the cells generally consist of steel wool which is trapped between perforated sheets which are made from a suitable plastics material and the anodes each consist of a composite unit which is made up of stainless steel strips.

For security reasons, the cell tank is closed by a lockable lid.

Although electrowinning cells of the above type are reasonably efficient their gold recovery rate is slow and a large percentage of gold remains trapped in the cathode wool which necessitates regular removal of the cathodes from the tank for maximum gold recovery by means of a calcine or acid treatment process. The removal of the gold laden cathodes from the tank is labour intensive and poses severe gold theft security problems.

SUMMARY OF THE INVENTION

A method of electrowinning metal such as gold, silver and the like from an eluate containing the metal in solution according to the invention includes the steps of feeding the eluate into a closed tank which includes a suitably spaced and electrified anode and cathode, electrolytically depositing the metal from the eluate onto the cathode and at least periodically causing the deposited metal to be dislodged from the cathode for removal from the tank.

The deposited metal may be dislodged from the cathode by movement of the cathode in the tank.

The cathode may be moved in the tank in any suitable manner, for example, by vibration, rapping, oscillation, rotation and the like or by any combination of these movements.

The method may further include the step of depositing metal which is dislodged from the cathode in a metal trap which is located on or is in communication with the base of the tank and from which the metal is periodically removed through a security protected outlet.

The method may include the step of feeding eluate which has been exposed to the cathode from the tank through a settling tank, gravity separating particulate metal from the eluate in the settling tank and periodically removing the separated metal from the settling tank.

After a predetermined operating period the barren eluate is drained from the cell system and the cathode is spray cleaned by means of liquid spray nozzles in the tank to remove gold particles which are trapped on or in the cathode.

An electrowinning cell for electrowinning metal such as gold, silver and the like from a metal rich eluate according to the invention includes a tank having an eluate inlet and outlet, a suitably insulated anode and a suitable electrowinning cathode in the tank in the eluate flow path through the tank between its inlet and outlet and means for dislodging metal which has been electrolytically deposited on the cathode from the cathode during use of the cell. The metal dislodging means may be a device or arrangement for moving the cathode in the tank. In addition to the cathode movement generating device or arrangement, the metal dislodging means could include a liquid spray jet arrangement.

The electrowinning cell could be any conventional cell which includes the cathode moving and the liquid spray arrangement of the invention for dislodging the metal from the cathode. In a preferred form of the invention, however, the electrowinning cell tank is for practical purposes permanently closed and the cell includes an axially rotatable shaft which is located in and projects from the tank with the cathode attached to the shaft for rotation with the shaft in the tank, means for rotating the shaft, an anode in the tank on the outside of a path circumscribed by the cathode during its rotation in the tank and suitable electrical connections for connecting the cathode and the anode to a suitable electrical supply.

The shaft rotating means may be adapted periodically to reverse the direction of rotation of the shaft and so the cathode in the tank. Preferably, the tank is a cylindrical vessel, and in one form of the invention the anode is a tubular sleeve which is circular in cross-section and which is concentrically located in the tank, the shaft is coaxially located in the tank with one end portion passing through an end wall of the tank and the cathode is a cathode panel which is attached to the shaft for rotation in the tank at least partially within the anode.

The cathode may, and preferably does, consist of a plurality of cathode panels which project radially from the shaft.

In another form of the invention the anode consists of two sheet metal cylinders which are concentrically spaced from and attached to each other and the cathode is cylindrical in shape and rotatably located between and spaced from the anode cylinders.

The cathode panels and the cylindrical cathode conveniently include a mat of stainless steel wire wool or knitted mesh which is sandwiched between suitably rigid open mesh material. The anode cylinders, in both forms of the cell, may be made from a suitable stainless steel.

Further according to the invention the cell includes suitably positioned liquid spray nozzles in the tank which are directed to spray jets of liquid onto the or each cathode panel as it is rotated in the tank and liquid supply lines to the nozzles.

The shaft rotating means is conveniently a motor which is attached to the tank end from which the steel shaft projects. The motor may be connected to the shaft through a suitable gearbox.

Further according to the invention the eluate inlet to the tank is above the anode and cathode in the tank and the tank outlet is located in its base with the cell including a metal trap which is in communication with the tank outlet below the tank base. The cell conveniently includes a valve for shutting the tank outlet from the metal trap and a security protected metal outlet valve from the trap from which the metal sludge is periodically withdrawn.

The cell of the invention may include a settling tank, on the outside of the cell tank, into which eluate which has passed through the cell tank may be fed from bottom to top to a line for recirculating the eluate through the cell tank feed system while particulate metal in the eluate settles to the bottom of the settling tank in use. The settling tank preferably includes a gold trap as described above.

BRIEF DESCRIPTION OF THE DRAWINGS

The invention is now described by way of example only with reference to the drawings in which:

FIG. 1 is a partially diagrammatic sectioned side elevation of one embodiment of the electrowinning cell of the invention, FIG. 2 is a plan view of the FIG. 1 cell shown sectioned on the line 2—2 in FIG. 1, FIG. 3 is a fragmentary exploded perspective view illustrating the manner of construction of the cathode panels of the electrowinning cell of FIGS. 1 and 2 of the invention.

DETAILED DESCRIPTION OF THE PREFERRED EMBODIMENT

Figure 4:
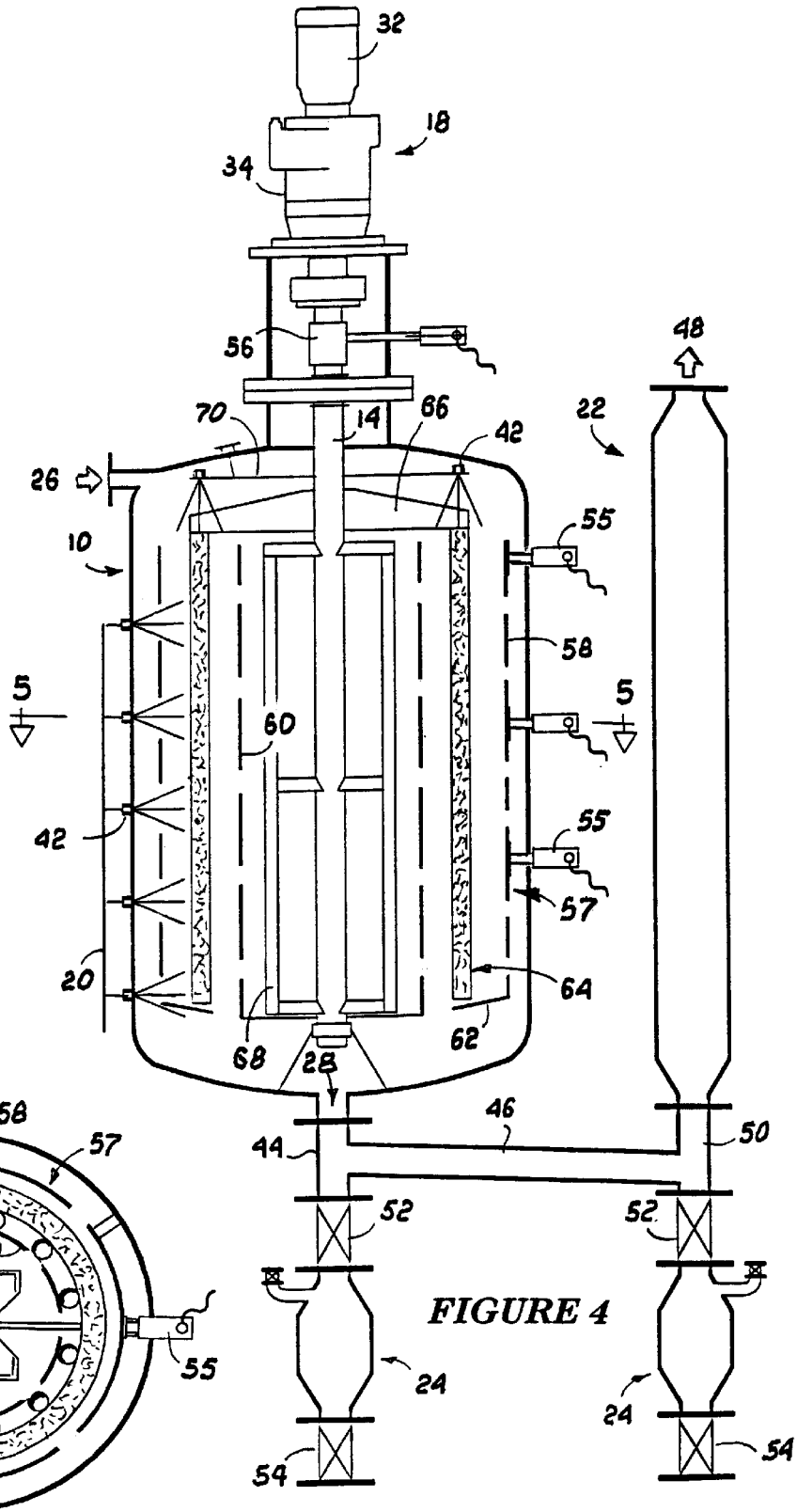
FIG. 4 is a view similar to FIG. 1 of a second embodiment of the electrowinning cell of the invention.

The electrowinning cell of the invention is shown in FIGS. 1 and 2 of the drawings to include a tank 10, an anode 12, a drive shaft 14, a cathode 16, a drive arrangement 18 for the shaft 14, water jet manifolds 20, a settling tank 22 and gold traps 24.

The tank 10, in this embodiment of the invention, is in the form of a cylindrical vessel which is closed top and bottom. The upper end of the tank is releasibly bolted to the side wall of the tank to be, for all practical purposes except maintenance, a permanent closure to the tank. The tank includes an eluate inlet 26 and an outlet 28 which is located in the downwardly curved base of the tank.

The anode 12 is in the form of an open ended cylinder which is made from a suitable stainless steel and which is concentrically located in the tank 10 by suitable insulators 30.

The drive shaft 14 is axially located in the tank 10 in bearings in the upper end cap of the tank with its free end on the outside of the tank being connected to the drive arrangement 18. The drive arrangement 18 consists of a suitably sized electric motor 32 and a gearbox 34 to which the shaft 14 is attached. Preferably the drive arrangement 18 is adapted, in any known manner, periodically to reverse the direction of rotation of the shaft 14 and so the cathode 16.

The cathode 16, in this embodiment, consists of four cathode panels 36 which each include, as shown in FIG. 3, a central mat 38 which is made from a suitable stainless steel wool or knitted mesh, two mesh elements 40 which could be made from stainless steel wire, a suitable plastics material or the like and between which the mat 38 is sandwiched. In this embodiment of the invention, the cathode consists of four electrically connected panels 36 which are attached in the radially projecting arrangement shown in FIG. 2, to the shaft 14. The shaft 14 is suitably insulated from a lower bearing holder in the drawing by a bearing which is made from electrically insulating material and from the gearbox drive shaft by a coupling which is electrically insulating.

The water jet manifolds 20 pass through the end closure of the tank 10 and are located between the inner surface of the anode 12 and the outer edges of the cathode panels 36 as shown in FIG. 1. Each of the water jet manifolds carries a plurality of spaced nozzles 42 which are directed into the tank to apply water jet streams at high pressure to the highly exposed surfaces of the cathode panels as they are rotated in the tank as will be explained below.

The water jet manifolds 20 are shown connected on the outside of the tank 10 through on/off valves, not shown, to a source of water under pressure.

The inlet to the settling tank 22 is connected, as shown in FIG. 1, to a tube 44, which is open to the cell tank outlet 28, by a tube 46 which enables eluate which has left the tank 10 to be pressure fed into the settling tank and from its outlet back through the cell feed system to the tank inlet 26.

The gold traps 24 are located in the cell system as illustrated in FIG. 1 with a first of the gold traps in alignment with the tube 44 and a second in alignment with an inlet/outlet tube 50 from the settling tank 22. Each of the gold traps includes an upper valve 52 for shutting the traps off from the cell system and lower outlet valves 54 which are security protected by key operated locks, remote control solenoids or the like which are not shown in the drawings.

The anode 12 is connected, through an insulator which passes through the wall of the tank 10 to a connector 55 to which the positive pole of the DC supply to the cell is connected in use. The drive shaft 14 and so the cathode 16 are connected to a suitably insulated wiper 56 which is engaged with the shaft 14, as shown in FIG. 1, for connection to the negative pole of the DC supply to the cell.

In use, the shaft 14 is rotated to cause the cathode to be rotated within the anode in the tank and gold rich eluate, from a carbon in pulp circuit, is fed into the tank to fill the cell tank 10 and the settling tank 22. With the electrical supply to the anode and cathode of the cell activated, soluble gold in the eluate is liberated from the eluate conventionally according to the following reactions:

$$0_2+4H^++4e\rightarrow 2H_2O \quad (1)$$

$$2H_2O+2e\rightarrow 2OH^-+H_2 \quad (2)$$

$$Au(CN)_2^-+\rightarrow Au+2CN^- \quad (3)$$

although the reduction of other metallic ions (such as $Ag(CN)_2^-$ and $Cu(CN)^2{}_3^-$ may also be important if they are highly concentrated.

Thermodynamically the reduction of oxygen is the most favourable.

The significant reactions at the anodes are:

$$2H_2O\rightarrow 4H^+O_2+4e \quad (4)$$

$$CN^-+2H_2O\rightarrow H^++NH_3+CO_2+e \quad (5)$$

$2CN^-\rightarrow(CN)_2+2e$ (Catalyzed by copper in solution) being the oxidation of water to oxygen gas and the oxidation of cyanide to ammonia and carbon dioxide or to cyanogen. The evolution of oxygen is the predominant reaction.

The gold particles which are liberated from the eluate are electrolytically deposited on the surfaces of the cathode panels 36 to form a gold rich sludge on the panels.

The rotation of the cathode panels in the eluate causes eluate turbulence against the faces of the panels which causes the gold sludge to be dislodged from the panels far sooner than is the case if the panels had been static and dislodgement of the gold sludge is purely dependant on gravity separation of the sludge from the panels. The gold sludge which is dislodged from the cathode panels gravitates through the eluate onto the base of the tank 10 and from there into the gold trap 24 below the tank outlet 28 through the open valve 52. The eluate is recirculated from the tank 10 through the settling tank 22 and back to the feed line to the inlet 20 of the tank 10. In the passage of the eluate through the settling tank 22 gold particles in the eluate, which were not deposited onto the cathode panels 36, gravitate out of the electrolyte in the settling tank 22, through the tube 50, the open valve 52 and into the gold trap 24 beneath the settling tank. The gold trapped in the gold traps 24 is removed from time to time by closing the valves 52 and opening the valves 54.

The exposed combined cathode area in the tank 10, in the cell of this embodiment of the invention, is about $3^2$ m and the cell is designed to operate according to the following operating parameters:

| | | |
|---|---|---|
| i. | Reactor Current | 600 to 850A |
| ii. | Reactor Voltage (measured across busbars) | 4 to 7v |
| iii. | Electrolyte pH value | Above 12 |
| iv. | NaOH concentration | Above 0, 4% |
| v. | Electrolyte conductivity | Above 1, 66 $Sm^{-1}$ |
| vi. | Electrolyte resistivity | Below 60 OHM cm |
| vii. | Flow Rate | 200–400 $l/min^1$ |
| viii. | Temperature | Above 20° C. |
| ix. | Mass s/s knitted mesh or wool | ± 18, 0 kg |

These conditions will allow the cell to recover 60–75 percent of the gold in solution entering the cell (i.e. if simultaneous samples of electrolyte entering and leaving the cell are collected then 100×(1−C out/C in) should be greater than 60, where Cin and Cout are the concentrations of gold entering and leaving the reactor. For Cin greater than 200 p.p.m. somewhat lower extraction recoveries are to be expected.

When the electrowinning cell of the invention has completed a predetermined period of operation the electrical supply to the anode is terminated. With the gold rich sludge removed from the traps 24, the valves 52 and 54 of both traps are opened to drain the now barren eluate from the tanks 10 and 22. The valves 54 are now closed. The cathode is rotated in the now dry tank 10 and its panels 36 are water spray washed by means of the nozzles 42 to dislodge gold sludge which has been trapped in the low adhesion stainless steel knitted mesh or wool of the cathode panels from the panels to gravitate, as described above, into the gold traps 24 from which the sludge is removed. This step in the electrowinning process of the invention results in optimum gold recovery from the system without having to remove the cathode panels from the tank 10 except for very occasional internal maintenance or repair of the tank and its components. The security of the system may further be enhanced by automatically discharging gold sludge from the gold trap valves 54 at predetermined intervals into sealed sludge containers.

Figure 5:
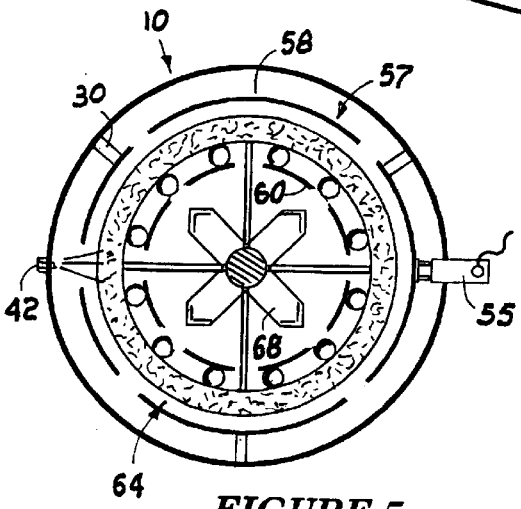
FIG. 5 is a plan view of the FIG. 4 cell shown sectioned on the line 5—5 in FIG. 4.

The bulk of the components of the embodiment of the electrowinning cell illustrated in FIGS. 4 and 5 are the same as those of the FIG. 1 embodiment with these components having the same reference numbers as those used in the description of the cell of FIGS. 1 to 3 and therefore require no further explanation.

The fundamental differences between the two embodiments of the cell of the invention lies in the cathodes and anodes of the two cells.

The anode 57 of the cell of FIGS. 4 and 5 is a composite anode consisting of two anode cylinders 58 and 60 which are held concentrically together by a floor 62 which is fixed to and extends between them. The anode floor 62 slopes downwardly from the lower edge of the cylinder 58 to the edge of the cylinder 60. The anode cylinder walls are holed for the passage of eluate through and between them and the floor 62 is holed, as seen in FIG. 5, against the cylinder 60 to enable gold rich sludge to gravitate out of the space between the cylinders. The anode cylinder 58 is held in the tank in the same manner as that of the FIG. 1 anode by means of insulated spacers 30 which are shown in FIG. 5. The anode cylinder 58 includes a vertical row of holes which are in register with the water spray nozzles 42 to enable the water sprays to reach and penetrate the cathode during the water jet washing cycle of operation of the cell.

The cathode 64 in this embodiment of the invention is cylindrical and of the same construction as the cathode panels of FIGS. 1 and 2. The cathode 64 is located in the gap between the anode cylinders with its outer surface spaced from the cylinders as shown in the drawings. The cathode is held in position and rotated between the anode cylinders by cross beams 66 which are attached to the cathode and its drive shaft 14.

To stir the eluate in the otherwise largely dead space in the anode cylinder 60, the drive shaft 14 carries a paddle or agitator arrangement 68. On rotation of the paddle arrangement the eluate on the inside of the anode cylinder 60 is stirred and a percentage of the stirred eluate is caused to enter the cathode space between the anode cylinders through the holes in the wall of the cylinder 60.

Another difference between the two cells is that the cell of the second embodiment includes water spray nozzles 42 which are downwardly directed onto the cathode from an overhead ring manifold 68 in addition to the nozzles which are located in its side wall.

The cell of FIGS. 4 and 5 functions in the same manner as that of FIGS. 1 and 2 with the gold sludge being turbulence stirred from the surfaces of the cathode as it is rotated. The dislodged sludge particles gravitate onto the anode floor and from the floor through the holes in it onto the base of the tank 10 and from there into the trap 24.

Yet another small difference between the two cells is that the water jet manifold 20 of the FIGS. 4 and 5 embodiment is situated on the outside of its tank 10 as opposed to inside it as is the case with the FIG. 1 cell.

I claim:

1. An electrowinning cell for electrowinning metal from a metal rich eluate comprising:

a closed tank having an eluate inlet and outlet;

an electrically insulated cylindrical sheet metal anode;

a cathode within the anode consisting of a pad of suitable wire wool which is sandwiched between two layers of open mesh material;

a rotatable shaft which is fixed to the cathode;

means for rotating the shaft and cathode in the anode to dislodge metal which has been electrolytically deposited on the cathode, from the cathode, in use;

a settling tank on the outside of the closed tank;

fluid lines between the base portions of the two tanks and between the upper end of the settling tank and an eluate feed line to the eluate inlet to the tank for recirculating eluate from the settling tank back to the closed tank; and security protected metal traps in bases of both the closed tank and the settling tank.

2. An electrowinning cell as claimed in claim 1, wherein one end portion of the shaft passes through and is sealingly rotatable in an end wall of the closed tank, and the shaft rotating means is a motor and gearbox arrangement which is mounted on the closed tank.

3. An electrowinning cell as claimed in claim 1, wherein the cathode consists of a panel of suitable wire wool which is sandwiched between two layers of open mesh material.

4. An electrowinning cell as claimed in claim 1, wherein the shaft is rotatable on the anode axis, and the cathode consists of a plurality of electrically connected planar cathode panels which are attached to and project radially from the shaft in the anode.

5. An electrowinning cell as claimed in claim 1, wherein the anode consists of two cylinders which are concentrically spaced from and attached to each other, and the cathode is cylindrical in shape and rotatable between and spaced from the anode cylinders.

6. An electrowinning cell as claimed in claim 5, wherein the anode cylinders are holed for the passage of eluate through and between them during operation of the cell.

7. An electrowinning cell as claimed in claim 6, including a paddle arrangement which is parallel to and fixed to the drive shaft to be spaced from and extend over a substantial portion of the length of the wall of one of the anode cylinders for causing eluate movement in the tank and through the holes in the anode cylinders.

8. An electrowinning cell as claimed in claim 1, wherein the metal traps below the bases of the tank and settling tank include inlet valves for closing the traps to the tanks.

9. An electrowinning cell as claimed in claim 8, wherein each metal trap includes a security protected metal outlet valve through which metal is periodically removed from the traps.

* * * * *